US006558227B1

(12) United States Patent
Kodaira et al.

(10) Patent No.: US 6,558,227 B1
(45) Date of Patent: May 6, 2003

(54) METHOD FOR POLISHING A WORK AND AN APPARATUS FOR POLISHING A WORK

(75) Inventors: Masao Kodaira, Nagano (JP); Mikio Nakamura, Nagano (JP); Takahiro Kida, Nagano (JP)

(73) Assignee: Shin-Etsu Handotai Co., Ltd., Tokyo (JP)

( * ) Notice: Subject to any disclaimer, the term of this patent is extended or adjusted under 35 U.S.C. 154(b) by 0 days.

(21) Appl. No.: 09/869,146

(22) PCT Filed: Oct. 27, 2000

(86) PCT No.: PCT/JP00/07546

§ 371 (c)(1),
(2), (4) Date: Jun. 26, 2001

(87) PCT Pub. No.: WO01/30538

PCT Pub. Date: May 3, 2001

(30) Foreign Application Priority Data

Oct. 27, 1999 (JP) ..... 11-305145

(51) Int. Cl.[7] ..... B24B 1/00

(52) U.S. Cl. ..... 451/5; 451/41; 451/57; 451/66; 451/287; 451/290

(58) Field of Search ..... 451/41, 288, 287, 451/290, 5, 57, 66

(56) References Cited

U.S. PATENT DOCUMENTS 5,924,916 A 7/1999 Yamashita
6,213,852 B1 * 4/2001 Fujii et al. ..... 451/285
6,340,327 B1 * 2/2002 Afif ..... 451/444

FOREIGN PATENT DOCUMENTS

JP 7-201786 A 8/1995
JP 9-174430 7/1997

* cited by examiner

*Primary Examiner*—George Nguyen
(74) *Attorney, Agent, or Firm*—Oliff & Berridge, PLC

(57) ABSTRACT

There is disclosed a method for polishing a work wherein polishing liquid is supplied to a polishing pad, and a relative movement is carried out between the work and the polishing pad with pressing the work on the polishing pad, wherein the work of which press pressure was set to 0 to terminate polishing is released from the polishing pad within 45 seconds after the termination of polishing. When plural works are simultaneously polished, preferably only the work to which press pressure was set to 0 to terminate polishing is released from the polishing pad, and polishing of the other works is continued, which are released from the polishing pad after press pressure thereto is set 0 one by one. In the resultant work, corrosion on the surface of the work due to the polishing liquid can be suppressed, an amount of the cleaning liquid used in a cleaning process can be reduced, particles can be removed efficiently in a short time, almost no pits are formed on the surface after polishing, only few amounts of particles are adhered, and there is almost no deviation in the works.

4 Claims, 3 Drawing Sheets

METHOD FOR POLISHING A WORK AND AN APPARATUS FOR POLISHING A WORK

TECHNICAL FIELD

The present invention relates to a method for polishing a work and an apparatus for polishing a work, more particularly to a method for polishing a plane portion of a work, such as a surface of a semiconductor wafer, with a polishing pad. More particularly, the present invention relates to a method of releasing a work from a polishing pad after polishing and a polishing apparatus for conducting the method.

BACKGROUND ART

Conventionally, an apparatus equipped with work holding plates made of metal, ceramics, glass or the like which are attached respectively to rotary a plurality of holders which can rotate and a polishing pad attached to a polishing turn table which can rotate is known as an apparatus for polishing a surface of a work, such as a semiconductor wafer.

The method for polishing a surface of a work using such a polishing apparatus is generally conducted as follows. The side opposite to the surface to be polished of each of the works is attached to a work holding surface of each of the work holding plates so that the work is held, which are then moved relatively to the polishing pad so that the plural works are polished at the same time, with pressing the side to be polished of the work on the polishing pad and with supplying polishing liquid on the polishing pad.

There are various methods for holding a work, including a method wherein one or more wafers are adhered to a work holding plate with wax, or a method of holding a wafer by vacuum-sucking to a work holding plate.

A method of polishing using a four axes polishing apparatus equipped with four work holding plates will be explained hereinafter in more detail. Predetermined number of works are held on each of the work holding plates, they are polished at the same time by rotating both a polishing turn table and all of the work holding plates, with supplying polishing liquid on a polishing pad and with pressing four works on the polishing pad simultaneously. In this case, in order to press the surface to be polished of the work on the polishing pad by predetermined pressure, in addition to the pressure by its own weight of the work holding plate or the like, compulsory pressure (this pressure applied compulsorily is called press pressure) is suitably applied between the surface to be polished of a work and a polishing pad through a work holding plate by a pressure applying means. After polishing the work surface to a desired polishing amount, press pressure of each of four works to a polishing pad is set about 0 simultaneously, to terminate polishing substantially. Subsequently, the work holding plates are pulled up, and the works are released from the polishing pad, and further the works are removed from a holding plate.

For example, when a work is a semiconductor wafer, the wafer polished and released from the polishing pad as described above is usually transferred to the following cleaning process. In many cases, the work is kept in pure water or a solution wherein ozone, hydrogen peroxide, or the surface-active agent is added to pure water until it is transferred to the cleaning process after polishing process. It is conducted in order to remove the polishing liquid adhered to the wafer surface after polishing. Furthermore, if the polished wafer is left as it is in the atmosphere, particles adhered to the wafer surface at the polishing process are dried and stuck thereto, and it is difficult to remove them by cleaning in the following process. Accordingly, it is temporarily kept in pure water or the like as described above.

Removal of the polishing liquid or particles adhered to the surface as described above is necessary not only after a semiconductor wafer is polished, but also after any works are polished.

As described above, after the works held on the work holding plate are simultaneously pressed on the polishing pad and polished, to a desired polishing amount, the applied pressure is set about 0 simultaneously to terminate polishing. At this time, the work is in contact with the polishing pad and is left on the polishing pad. Subsequently, the work is released from the polishing pad by pulling up the work holding plate further. The works are not released from the polishing pad simultaneously, but are released from the polishing pad one by one.

Accordingly, time until the work is released from the polishing pad after termination of polishing (hereinafter referred to as "leaving time") varies depending on works. Evaluation of each surface of each work with a particle counter revealed that there was a tendency that on the wafer left on the polishing pad after polishing for longer time, the number of counts was larger.

Generally, the defect represented as particles by a particle counter using optical measurement is called LPD (abbreviation for Light Point Defect), which includes, in addition to particles adhering to the work surface, depression formed as a result of corrosion of the defect on the work surface caused by a chemical action of a polishing liquid (hereinafter referred to as pit), and other form irregularities or the like which may cause optical scattering. Therefore, the measured value represents the sum of them.

Usually, polishing of a semiconductor wafer, such as silicon wafer is conducted by chemical mechanical polishing (CMP) which is combination of the mechanical polishing action by the polishing particle or the like and the chemical polishing action by the substance having an etching action for works, such as alkali, amines or the like, in order to prevent the damage from remaining on a polished side. Therefore, a chemical action with polishing liquid can be uneven etching with the substance having an etching action.

Accordingly, it is considered that the reason why the count number measured with the particle counter is larger when the leaving time of the wafer is longer, may be that fine particles such as polishing particles contained in a polishing liquid remaining and adhered on the polished surface of the work are increased, that local corrosion of the polished surface of the work by the chemical action of the polishing liquid progresses with time and the number of fine depressions (pits) increases, or both of them.

It is possible to remove the fine particles adhering to the surface of the polished work by cleaning. However, in order to clean the plural works at the same time and to remove particles from all of the works, it is necessary to clean the works so that a work to which the largest amount of particles are adhered may be cleaned, and cleaning for a long time must be performed after all.

Such long time cleaning causes, in addition to the problem that cost is raised as a result of using a lot of cleaning liquid, a disadvantage that efficiency is low, since a work to which a little amount of particles are adhered is cleaned for a unnecessarily long time.

Moreover, in the work to which too many particles are adhered, it is difficult to remove them by usual cleaning, which may cause the problem of contamination by particles in a product after all.

The reason why a difference appears in the value of LPDs depending on the leaving time after termination of polishing until releasing of the work from a polishing pad is not certain. However, in a multi axes apparatus, while the number of works that can be processed (polished) at once is increased, but it comes to require time until all works are collected in a storage tank. It is thought that the wafer surface is very active immediately after processing and is easy to receive contamination by the metal ion or the foreign substance, and therefore, the particle level of the wafer gets worse as the time necessary for collection of the wafer becomes long.

Among of them, the most serious problem is increase of pits as a result of corrosion with polishing liquid. Once they are formed on the surface of a work, they cannot be removed by cleaning, and thus lowering of the quality of the work cannot be avoided.

DISCLOSURE OF THE INVENTION

The present invention has been accomplished to solve the above-mentioned problems, and an object of the present invention is to provide a method for polishing a work wherein formation of pits on the surface of a work due to polishing liquid can be prevented, an amount of the cleaning liquid used in a cleaning process can be reduced, particles can be removed efficiently in a short time, the value of LPD detected on the surface is low, and there is almost no deviation between works, and a work polishing apparatus therefor.

In order to achieve the above-mentioned purpose, the present invention provides a method for polishing a work wherein polishing liquid is supplied to a polishing pad, and a relative movement is carried out between the work and the polishing pad with pressing the work on the polishing pad, characterized in that the work of which press pressure was set to 0 to terminate polishing is released from the polishing pad within 45 seconds after the termination of polishing.

As described above, concerning the defect on the surface of a work, since formation of pits is caused by corrosion due to the polishing liquid, it is desirable to release the work from the polishing pad as early as possible after polishing.

The inventors of the present invention investigated the relation between time until a work is released from a polishing pad after polishing and the number of counts on the work surface measured with the particle counter, and found that if the work was released from the polishing pad within 45 seconds after polishing was terminated by setting press pressure of the work to 0 as mentioned above, the number of counts measured by the particle counter could be controlled to be small, and thus it was satisfactory in quality. Namely, by releasing the work from the polishing pad within 45 seconds as described above, the corrosion on the surface of the work due to the polishing liquid on the polishing pad can be suppressed, and LPD due to pits can be suppressed.

Moreover, the amount of the particles adhered on the surface of a work can also be decreased by releasing the work after polishing from a polishing pad in a short time of 45 seconds or less as described above. Therefore, an amount of the cleaning liquid used in a cleaning process can be reduced, and particles can be removed surely and efficiently in a short time.

In the present invention, "setting press pressure to 0" means canceling compulsory force of the work held on the work holding plate against the polishing pad. The load by weight of the work itself or the ceramic plate or the like to which the work is adhered is not included in the press pressure as used in the present invention.

Moreover, according to the present invention, in the polishing method wherein plural works are simultaneously polished by relative movement between the works and a polishing pad with pressing the works on the polishing pad and supplying the polishing liquid to the polishing pad, wherein only the work of which press pressure was set to 0 to terminate polishing is released from the polishing pad within 45 seconds, while polishing of the other works can be continued.

As described above, if only the work of which press pressure was set to 0 to terminate polishing is released from the polishing pad, and the other works are kept to be polished, the work which had been polished as described above can be released from the polishing pad within 45 seconds, corrosion due to the polishing liquid of the surface can be suppressed, and only few amount of particles are adhered thereon. The other works are not left on a polishing pad unlike in a conventional method, since these works are kept to be polished.

In some cases, the so-called water polishing supplying only water may be performed after stopping supply of the polishing liquid. Also in this case, increase in pits of the surface occurs due to the remaining polishing liquid, and thus it is desirable to release the work within 45 seconds after pressing of a work is stopped.

Moreover, when a work is a semiconductor wafer, polishing is often conducted in several steps. The polishing method of the present invention is effective for polishing in each step. However, in the stepwise polishing, the amount of polishing is fewer in the latter step, and therefore, influence with polishing liquid needs to be suppressed more in the latter step. Therefore, the present invention is especially effective for polishing in the last step in which the amount of polishing is the fewest, namely so-called finish polishing.

Furthermore in this case, it is desirable that the press pressure of the plural works is set to 0 in turn so that the work is released from the polishing pad.

Namely, only the work of which press pressure was set to 0 to terminate polishing is released from the polishing pad within 45 seconds after polishing, whereas the other works are kept to be polished. Subsequently, polishing of either of the works which are kept to be polished is terminated one by one or simultaneously. Then, only the work after termination of polishing is released from the polishing pad within 45 seconds after polishing, whereas the other works are still kept to be polished. When the press pressure of plural works is set to 0 to release the work from the polishing pad in turn, one set of works of which press pressure against the polishing pad are simultaneously controlled may be released as a group, namely group by group.

The remaining works which are being polished are also released from the polishing pad one by one according to the above-mentioned procedure. By releasing all works from the polishing pad within 45 seconds after polishing, there can be obtained works wherein corrosion due to the polishing liquid on the work surface is suppressed, only few particles are adhered, LPD value is significantly small, and there is little variation between the works.

Furthermore, the present invention provides a polishing apparatus for works having at least one or more work holding plates for holding works and a turn table on which a polishing pad is fixed, and polishing plural works simultaneously by relatively moving the works and the polishing pad with pressing the works held on the work holding plate to the polishing pad and with supplying the polishing liquid to the polishing pad, characterized in that each of the work holding plates has a function of setting press pressure to 0 to terminate polishing independently and releasing the work after polishing from the polishing pad within 45 seconds.

As described above, if a work is polished using a work polishing apparatus equipped with not only single work holding plate but also plural work holding plates having a function of setting press pressure to 0 to terminate the respective polishing independently and releasing the work after polishing from the polishing pad within 45 seconds, each of the works held on the work holding plate can be released one by one from the polishing pad within 45 seconds after termination of polishing, and thereby there can be obtained works having excellent surface quality wherein corrosion due to polishing liquid can be suppressed, only few amounts of particles are adhered, and thus LPD value is significantly small, and there is no variation between the works.

As described above, the present invention relates to a method for polishing works wherein polishing liquid is supplied to a polishing pad, and a relative movement is carried out between the work and the polishing pad with pressing the work on the polishing pad, characterized in that the work of which press pressure was set to 0 to terminate polishing is released from the polishing pad within 45 seconds after the termination of polishing. As described above, the work released from the polishing pad in a short time after termination of polishing as described above has almost no pits formed as a result of corrosion due to polishing liquid, and has excellent surface quality. Furthermore, only few amounts of particles are adhered, and there is no deviation in the works. Accordingly, an amount of the cleaning liquid used in a cleaning process can be reduced, and particles can be removed efficiently and certainly in a short time. Thus, a work having an excellent surface quality can be surely obtained.

BEST MODE FOR CARRYING OUT THE INVENTION

The present invention will be further described below in detail, referring to drawings, but is not limited thereto.

Figure 1:
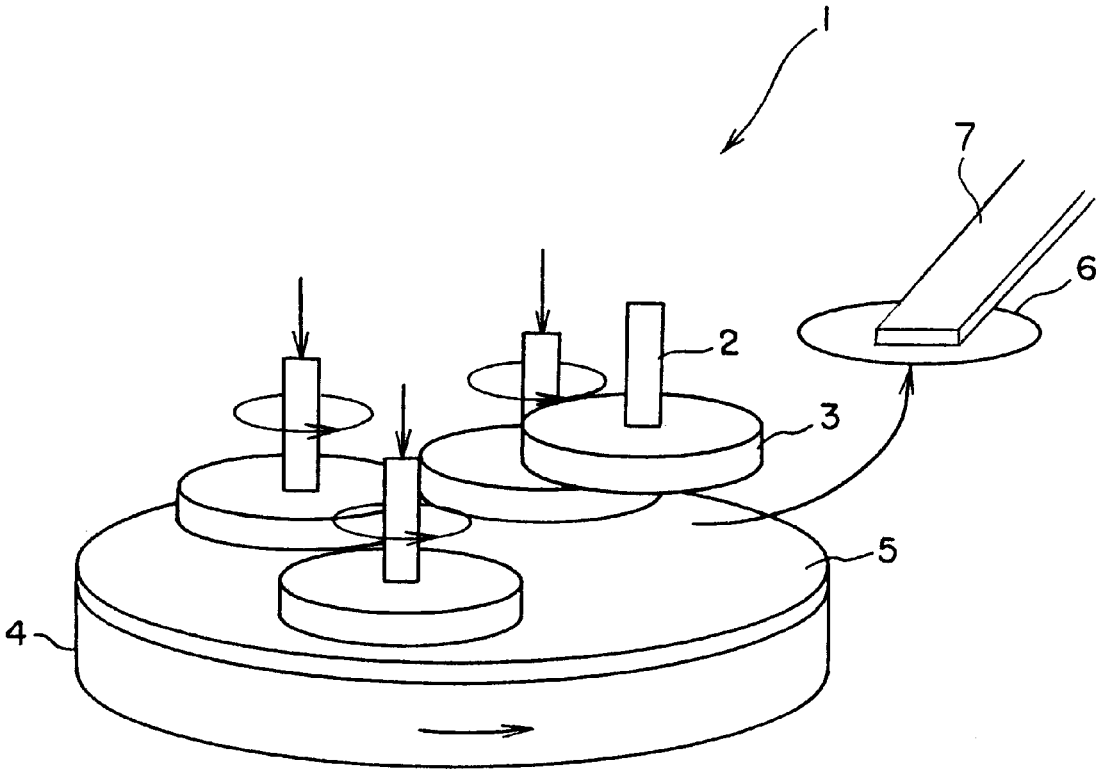
FIG. 1 is a schematic view showing an example of the work polishing apparatus according to the present invention.

FIG. 1 is a schematic view showing an example of the work polishing apparatus according to the present invention. The polishing apparatus 1 shown in the figure is equipped with work holding plates 3 each of which is attached on four rotary holders 2 respectively and a turn table 4. The polishing pad 5 is fixed on the turn table 4. Plural holes (not shown) perpendicular to a work holding surface are formed in the work holding plate 3. The holes communicate a vacuum line (not shown) in the rotary holder 2.

The works 6 such as a semiconductor wafer to be polished are held on the holding plate 3 by vacuum sucking to the work holding surface through the hole and the vacuum line. The figure illustrates the case that one work is held on one work holding plate.

The polishing apparatus 1 is also equipped with a robot arm 7, wherein the vacuum sucking mechanism is provided at the tip part, for releasing the work 6 from the polishing pad 5.

As shown in FIG. 1, each of the work holding plate 3 can set press pressure to 0 to terminate polishing independently, enabling release from the polishing pads 5 within 45 seconds in the polishing apparatus of the present invention. Namely, by controlling an operation speed of the robot arm 7, the work can be released from the polishing pad 5 within 45 seconds after setting press pressure against the work to 0. In the figure, polishing is completed only on the right-hand side axis (rotary holder 2), the work is released from the polishing pad 5, and polishing is continued with the other three axes.

The manner until termination of polishing in the method of polishing a work 6 using such a polishing apparatus 1 is fundamentally the same as the case of the conventional polishing apparatus mentioned above.

Namely, each work 6 held on the work holding plate 3 and the polishing pad 5 are relatively moved with pressing the work to the polishing pad 5 which is fixed on the turn table 4, and with supplying polishing liquid. Thereby, plural works 6 are polished simultaneously to a certain stock removal. When polishing a semiconductor wafer as a work, foamed polyurethane, a velour type pad, and suede type pad may be used as a polishing pad, and colloidal silica to which alkali, ammonia, amine or the like is added may be used as polishing liquid, using suitably a thing.

According to the conventional method, after polishing as mentioned above, polishing is terminated substantially by setting all press pressures by four holding plates to 0 at the same time, and then the holding plates are pulled up one by one to release vacuum sucking. Thereby, the works are removed from the holding plates.

However, the present invention is characterized in termination of polishing and release of the work from the polishing pad.

Namely, the work to which press pressure is set to 0 to terminate polishing is released from a polishing pad within 45 seconds according to the present invention. In order to release a work from a polishing pad within 45 seconds after polishing as described above, all the work holding plates 3 may be released from the polishing pad 5 at once after polishing. Alternatively, one work 6 may be released from the polishing pad 5 first, the while the other three works 6 may be kept to be polished, and all works may be released from the polishing pad 5 within 45 seconds after each polishing is terminated so that these three works are released from the polishing pad 5 one by one.

Thereby, the work of which polishing was terminated can be taken out quickly, and time until the work is released from the polishing pad after termination of polishing in each work can be made almost the same. Therefore, the LPD value measured by a particle counter for every work can be small, and the deviation is also small.

In this case, although the difference in stock removal will be made between the work first released from the polishing pad after termination of polishing and the work last released from the polishing pad after termination of polishing, the difference is only about 0.1 to 1% of the total polishing amount in practice, which does not become a problem.

The present invention will be described in mote detail by the following Examples and Comparative Examples.

Example 1 and Comparative Example 1

A semiconductor ingot produced according to Czochralski method was subjected to slicing, chamfering, lapping, and etching in accordance with a conventional method, to produce semiconductor wafers having a diameter of 200 mm. Three wafers were adhered to every glass plates with wax, and planarization was achieved by two steps of rough polishing (primary polishing, secondary polishing) using a polishing apparatus. Then, the surfaces of the wafers were simultaneously subjected to finish polishing with supplying polishing liquid (colloidal silica+ammonia) to the polishing pad for finish (suede type). When polishing at the desired polishing amount was performed, the press pressure to the polishing pad of all wafers was set to 0, and polishing was terminated (this time is defined as 0 second). The wafer adhered to the first plate was released from the polishing pad after 20 seconds, and was kept in pure water. Furthermore, after 45 seconds, 65 seconds, and 110 seconds, respectively, the wafers on each plate were released from the polishing pad, and were kept in pure water.

The wafers polished as mentioned above and kept in pure water were taken out, and cleaned with SC-1 solution (mixed cleaning liquid consisting of ammonia, hydrogen peroxide and water) and SC-2 solution (mixed cleaning liquid consisting of hydrochloric acid, hydrogen peroxide and water). Then, the surface of each wafer was evaluated by narrow channel using a particle counter SP-1 (manufactured by KLA-Tencor corporation).

Figure 2:
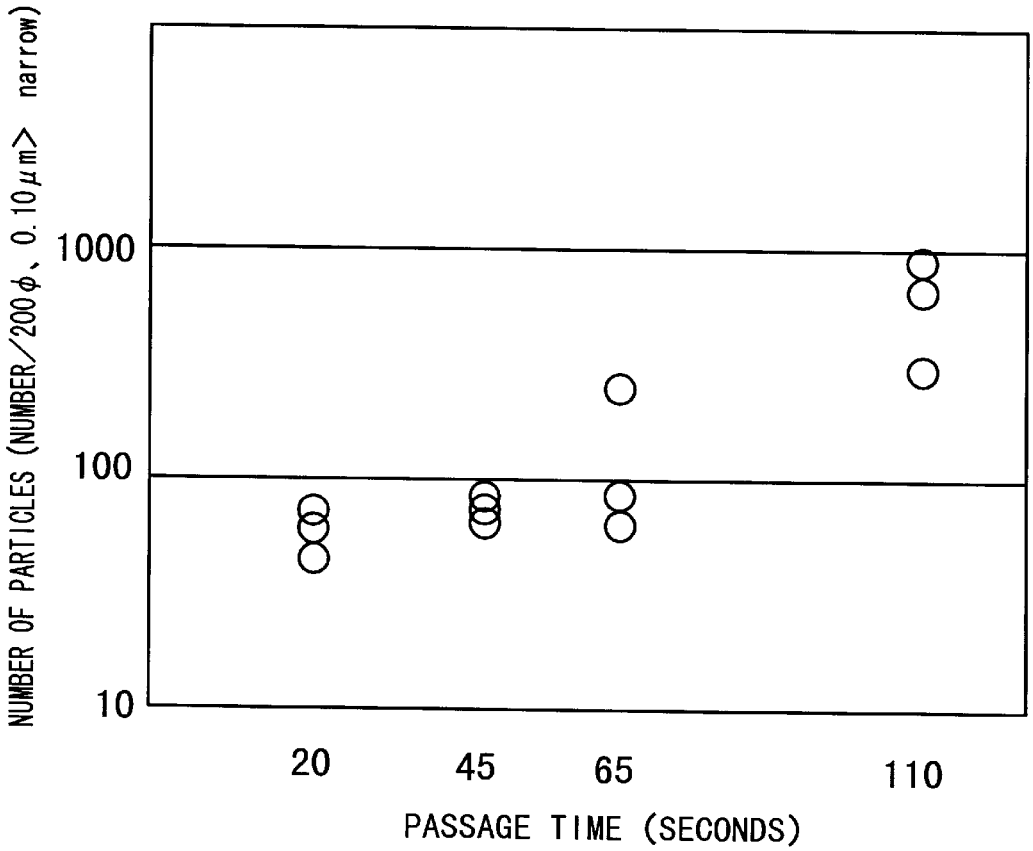
FIG. 2 is a graph which shows the number of particles on the cleaned semiconductor wafer surface after polishing in Example 1 and Comparative Example 1.

The results were shown in the graph of FIG. 2 as the number of counts of particles having a size of 0.1 $\mu$m or more. The counted number includes not only particles adhering to the wafer surface, but also the pits formed on the surface. For convenience, all of them are called the number of counts, or the number of particles.

As shown in the graph of FIG. 2, all of the numbers of particles on the wafers released from the polishing pad in 20 seconds or 45 seconds after polishing was terminated were 100 particles/200ϕ (0.32 particles/$cm^2$) or less, and therefore the wafers with no problem in quality could be produced. The number of particles on the wafers released in 65 seconds after the termination of polishing were 100 particles/200ϕ or less as for two of three wafers, and therefore the wafers have no problem in quality, but more than 100 particles/200ϕ as for one of three wafers. It is considered that quality of the wafers were deteriorated, since the time until the wafer was released from the polishing pad after the termination of polishing was somewhat long.

Furthermore, the numbers of particles of all wafers released in 110 seconds after polishing were more than 100 particles/200ϕ. The quality of the wafers was significantly lowered.

Example 2

A semiconductor ingot produced according to Czochralski method was subjected to slicing, chamfering, lapping, and etching in accordance with a conventional method, to produce semiconductor wafers having a diameter of 200 mm. Using a four axis polishing apparatus as shown in FIG. 1, seven wafers were held on each of the work holding plate actuated by each axis, and subjected to planarization achieved by two steps of rough polishing (primary polishing, secondary polishing). Then, the surface of wafers was subjected to finish polishing with supplying polishing liquid (colloidal silica+ammonia) to the polishing pad for finish (suede type). The surfaces of 28 wafers were polished at the same time at a desired polishing amount. When polishing at a desired polishing amount was performed, the press pressure to the polishing pad on the work holding plate actuated by one of the axes was set to 0, and polishing of seven wafers was terminated, whereas the wafers on the work holding plates actuated by the other three axes were kept to be polished. Subsequently, the wafers after polishing were released from a polishing pad using a robot arm, and kept in pure water. Furthermore, the wafers with which finish polishing was continued were released from the polishing pad one axis by one axis in the same procedure as above, and they were kept in pure water.

The time until the wafer was released from the polishing pad after termination of the polishing as for seven wafers of the first axis (this time is defined as 0 second) was about 10 seconds, and the time was almost the same as the wafers of the remaining three axes. It took only about 90 seconds to release the wafers of the 4th axis from the polishing pad after polishing for the wafers of the first axis was terminated. Such time was no problem for stock removal.

Comparative Example 2

Using the four axis polishing apparatus similar to the above, wafers were subjected to planarization achieved by two steps of rough polishing (primary polishing, secondary polishing), and then to finish polishing with supplying polishing liquid (colloidal silica+ammonia) to the polishing pad for finish (suede type). The surfaces of 28 wafers wherein 7 wafers are held per each of the work holding plates were polished at the same time at a desired polishing amount. Then, according to the conventional method, the press pressure by all of four axes was set to 0 at the same time, and polishing was terminated. Then, with leaving the wafers on the polishing pad, the wafers were released from the polishing pad on each of the wafer holding plates one axis by one axis, and kept in pure water.

The time until the wafers of the first axis were released from the polishing pad after the termination of the finish polishing (this time is defined as 0 second) was about 10 seconds. The time until the wafers of the 4 th axis were released from the polishing pad was about 90 seconds. Namely, the time that the wafers held on each of the work holding plates were left on the polishing pad depends on the axis. When the wafer was released from the polishing pad later, the time was longer.

The wafers polished and kept in pure water as mentioned above were taken out from the pure water and cleaned with SC-1 solution and SC-2 solution, the surface of each wafer was evaluated by the narrow channel using the particle counter SP-1 (manufactured by KLA-Tencor), as described above in Example 1 and Comparative Example 1.

The results as for the wafers polished and cleaned as described above were shown in the graph of FIG. 3 as the number of counts of particles.

Figure 3:
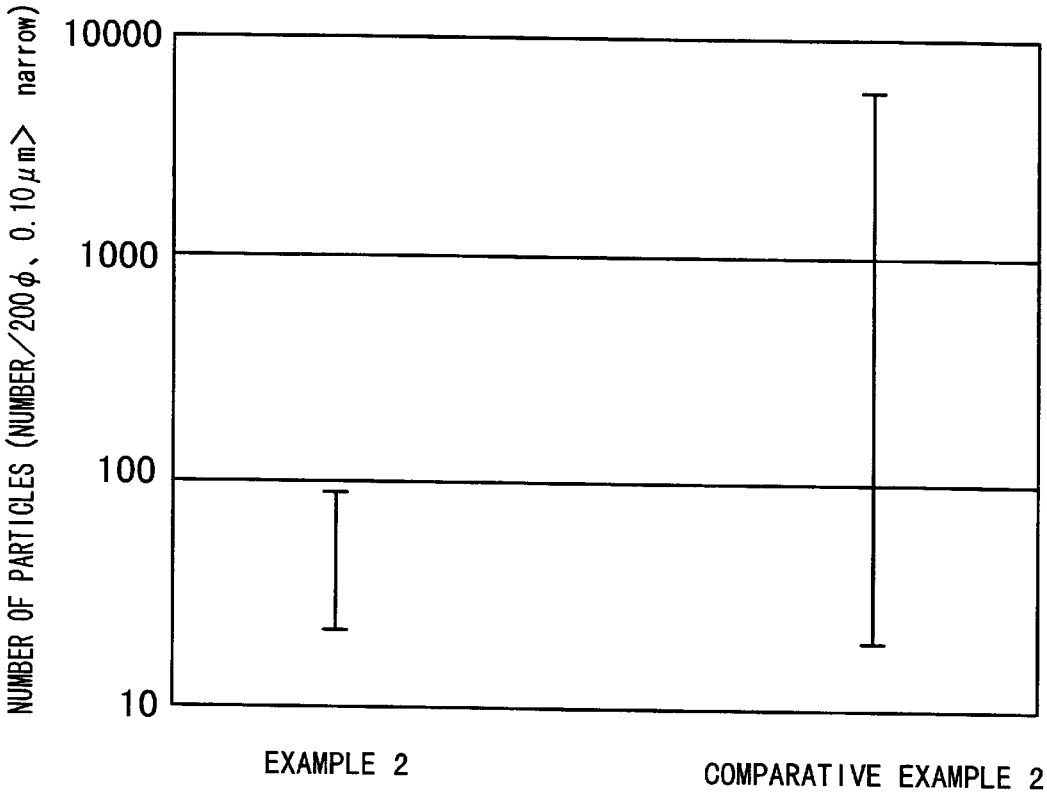
FIG. 3 is a graph which shows the number of particles on the cleaned semiconductor wafer surface after polishing in Example 2 and Comparative Example 2.

As shown in the graph of FIG. 3, the numbers of particles of all wafers polished in Example 2 were 100 particles/200ϕ or less, and deviation was small.

The numbers of particles of the wafers polished in Comparative Example 2 were near 10000 particles/200ϕ at the highest, and deviation was significantly large.

As shown in the results of Examples and Comparative Examples, the LPD value, namely the number of pits or adhered particles, or both of them on the surface of the wafers polished according to the present invention was hardly influenced by the order of releasing from the polishing pad and small, and the deviation was very little.

The present invention is not limited to the above-described embodiment. The above-described embodiment is a mere example, and those having the substantially same structure as that described in the appended claims and providing the similar action and effects are included in the scope of the present invention.

For example, the polishing apparatus which has four work holding plates was explained in the above embodiment. However, the number of the work holding plates is not limited thereto. For example, the polishing apparatus which has three or less, or five or more work holding plates can be used of course.

Moreover, although the semiconductor wafer was polished in Examples, the polishing method and a polishing apparatus of the present invention can be applied without being limited thereto. They can be applied to all works polished by the rotating polishing pad, such as a glass substrate, a quartz substrate, an oxide single crystal, and a magnetic disk or the like.

What is claimed is:

1. A method for polishing plural works, each having a surface to be polished simultaneously, comprising:

attaching a side opposite the surface to be polished of each of the works to work holding plate(s);

pressing the surface to be polished of the works on a polishing pad to a preset press pressure and supplying polishing liquid on the polishing pad;

carrying out a relative movement between the works and the polishing pad so that the plural works are polished at the same time;

terminating said polishing and setting said press pressure to 0; and releasing said surface to be polished from the polishing pad within 45 seconds after terminating said polishing, wherein all the works of which press pressure was set to 0 to terminate polishing are released from the polishing pad within 45 seconds after the termination of polishing.

2. The method for polishing according to claim 1, wherein only the work of which press pressure was set to 0 to terminate polishing is released from the polishing pad within 45 seconds, while polishing of the other works is continued.

3. The method for polishing according to claim 2, wherein the press pressure of the works is set to 0 in turn to release the work from the polishing pad in turn.

4. A polishing apparatus for works comprising:

at least one or more work holding plates for holding works, wherein each of the work holding plates has means for setting press pressure to 0 to terminate polishing independently, a polishing pad, a turntable on which the polishing pad is fixed, means for polishing plural works simultaneously by relatively moving the works and the polishing pad with pressing the works held on the work holding plate to the polishing pad;

means for supplying a polishing liquid to the polishing pad; and means for releasing the work after polishing from the polishing pad within 45 seconds.

* * * * *